US005993196A

United States Patent [19]

Young et al.

[11] Patent Number: 5,993,196

[45] **Date of Patent: *Nov. 30, 1999**

[54] BURNER APPARATUS

[75] Inventors: Timothy M. Young, Coppell, Tex.; Earl Ray Wade, Broken Arrow, Okla.

[73] Assignee: Halliburton Energy Services, Inc., Dallas, Tex.

[ * ] Notice: This patent is subject to a terminal disclaimer.

[21] Appl. No.: 08/918,156

[22] Filed: Aug. 25, 1997

Related U.S. Application Data

[63] Continuation of application No. 08/721,902, Sep. 27, 1996, abandoned, which is a continuation of application No. 08/226,599, Apr. 12, 1994, Pat. No. 5,636,980.

[51] Int. Cl.[6] ..... F23D 23/00

[52] U.S. Cl. ..... 431/202; 431/278; 431/350; 239/403; 239/419.3

[58] Field of Search ..... 431/202, 157, 431/352, 354, 287, 284, 283, 159, 351; 239/391, 403, 423, 464, 419.3

[56] References Cited

U.S. PATENT DOCUMENTS

| | | | |
|---|---|---|---|
| 2,701,608 | 2/1955 | Johnson | 158/1 |
| 3,565,562 | 2/1971 | Drivet | 431/184 |
| 3,603,711 | 9/1971 | Downs | 431/352 |
| 3,632,287 | 1/1972 | Reed et al. | 431/350 |
| 3,797,992 | 3/1974 | Straitz, III | 431/285 |
| 3,807,932 | 4/1974 | Dewald | 431/2 |
| 3,894,831 | 7/1975 | Glotin et al. | 431/4 |
| 3,914,094 | 10/1975 | Landry | 431/202 |
| 3,980,416 | 9/1976 | Goncalves et al. | 431/202 |
| 4,155,702 | 5/1979 | Miller et al. | 431/353 |
| 4,311,451 | 1/1982 | Matumoto et al. | 431/352 |
| 4,348,171 | 9/1982 | Issenmann | 431/202 |
| 4,412,811 | 11/1983 | Pedrosa, Jr. et al. | 431/202 |
| 4,419,071 | 12/1983 | Schwartz | 431/202 |
| 4,452,583 | 6/1984 | Brooks | 431/202 |
| 5,044,558 | 9/1991 | Young et al. | 239/391 |
| 5,058,808 | 10/1991 | Young | 239/464 |
| 5,067,657 | 11/1991 | Young et al. | 239/403 |
| 5,096,124 | 3/1992 | Young | 239/423 |
| 5,219,456 | 6/1993 | Theriot | 431/354 |
| 5,636,980 | 6/1997 | Young et al. | 431/202 |

FOREIGN PATENT DOCUMENTS

| | | | |
|---|---|---|---|
| 945471 | 4/1974 | Canada | 158/41 |
| 1195915 | 10/1985 | Canada | 158/131 |
| 0426477 | 5/1991 | European Pat. Off. . | |
| 2304856 | 10/1976 | France | 431/202 |
| 2 112 920 | 12/1981 | United Kingdom . | |
| 2185097 | 7/1987 | United Kingdom . | |
| 94/08178 | 4/1994 | WIPO . | |

OTHER PUBLICATIONS

Brochure entitled "Green Dragon High–Efficiency Burner" of Schlumberger dated Sep. 1993.

Page entitled "Smokeless Seadragon Burner" from Flopetrol catalog dated Nov. 1976.

*Primary Examiner*—James C. Yeung
*Attorney, Agent, or Firm*—Paul I. Herman; Neal R. Kennedy

[57] ABSTRACT

A burner apparatus for burning petroleum products during well testing. The apparatus comprises a plurality of burner nozzles for mixing air, oil or other flammable hydrocarbon, and in some cases steam, and discharges the mixture for burning. Each module may have a plurality of burner nozzles, and a plurality of such modules may be connected together. Each burner nozzle has a body with an air inlet and a fluid inlet, a nozzle insert disposed in the body and having an air port in communication with the air inlet and a fluid port in communication with the fluid inlet. Sealing is provided between the nozzle insert and the body. The body may also have a steam inlet, and the nozzle insert may also have a steam port in communication with the steam inlet, for directing steam into the apparatus to increase the mixing energy and temperature, thereby facilitating atomization. A single pilot and igniter system may be used for substantially simultaneously igniting the air and fluid mixture discharged from the nozzle inserts.

13 Claims, 4 Drawing Sheets

BURNER APPARATUS

This is a continuation of Ser. No. 08/721,902, filed on Sep. 27, 1996, now abandoned, which is a continuation of Ser. No. 08/226,599, filed on Apr. 12, 1994, now U.S. Pat. No. 5,636,980.

BACKGROUND OF THE INVENTION

1. Field of the Invention

This invention relates to burners for burning petroleum products during well testing, and more particularly, to a modular burning apparatus having nozzles for mixing air, oil, and in some cases steam, and which utilizes a single pilot source for igniting a plurality of burners.

2. Description of the Prior Art

When well tests are performed disposal of the petroleum or other hydrocarbon products therefrom is generally carried out by burning. One problem with burning the hydrocarbon products is in insuring that the burner can adequately handle the amount of hydrocarbons to be burned. This requires that the nozzles in the burner atomize the petroleum products as much as possible and that an adequate supply of air be provided to improve air ingestion to obtain as complete combustion as possible. Burners designed for such purposes are well known in the art.

U.S. Pat. No. 3,894,831 to Glotin et al. discloses a burner having multiple burner assemblies or nozzles which are pointed in slightly divergent directions. A ring-like water injection system is disposed around each burner nozzle, and the water acts to reduce the radiated heat from the burner and also to reduce the amount of black smoke generated in the combustion process. The apparatus may be swiveled so that the flame is directed downwind from the well. Other burners which have multiple nozzles, are rotatable and have water sprays include those disclosed in British Patent No. 2,112,920 to Dewald; U.S. Pat. No. 4,348,171 to Issenmann; and U.S. Pat. No. 3,797,992 to Straitz, III. U.S. Pat. No. 3,980,416 to Goncalves et al. discloses a single nozzle burner which is rotatable and has ring-shaped water sprayers.

U.S. Pat. No. 5,096,124 to Young, assigned to the assignee of the present invention, provides a burner with a body which may have a plurality of nozzle ports therein. A single petroleum connection and a minimum of air connections to the body are used. This apparatus also provides a burner with a water ring.

Of course, the energy obtained from oil and gas wells is vital in today's world. However, protecting the environment is also important. In the exploration of oil and gas, testing of the wells is necessary, but the disposal by burning of the liquid hydrocarbons produced during the well tests has been less than desirable from an environmental standpoint. This is an unfortunate result of the insufficient combustion and poor air ingestion obtained with many prior art burners. The present invention addresses this problem by providing a burner apparatus with improved efficiency to minimize or eliminate the undesirable smoke and oil fallout associated with the burning process.

Oil and/or gas is supplied to burners via pumps or directly from an oil and gas separator during the well test. Air is supplied from compressors. In the burner atomizers, energy from either the oil flow, air flow, or a combination of both, cause the liquid fuel to be sprayed in the form of tiny droplets into the air. Generally, a propane-fueled pilot and igniter system provides an ignition source, and thus, the liquid fuel spray is combusted in open air. Any improvement in the atomization process results in more efficient burning.

SUMMARY OF THE INVENTION

In the present invention, atomization is improved by increasing air flow, rather than increasing oil flow by higher oil pressures. This is done for a number of reasons. First, reducing the size of oil passages to increase the pressure also increases the chance of these passages becoming plugged. Also, as the liquid oil flow rates increase, erosion problems with the nozzles are worsened. Increasing the pressure also raises initial and maintenance costs because higher pressure pumps are required, and increased pressures always raise safety considerations with piping, particularly when the potential for plugging is increased. Increasing the oil pressure also results in fewer opportunities to flow oil directly from the separator, rather than using pumps. Basically, increasing the air flow rate instead eliminates these problems and results in operational simplicity.

The burner nozzle in the present invention utilizes high velocity air, and in some embodiments, steam in addition to the air, to increase atomization and therefore raise burning efficiency. The apparatus is also lightweight and compact which facilitates installation and maintenance. The burner has excellent turndown. That is, the performance of the burner is good over its entire flow rate range. Because the apparatus is of a modular design, increasing the flow rate merely requires that additional modules be installed as necessary.

The burner apparatus of the present invention comprises one or more burner modules. Preferably, each burner module comprises a plurality of burner nozzles, the benefits of which are increased air ingestion and turbulence which improves the combustion process. Each burner nozzle itself comprises a body defining a body cavity therein and an air inlet and a fluid inlet in communication with the body cavity, a nozzle insert disposed in the body cavity and defining a central opening therethrough and an air port in communication with the air inlet and a fluid port in communication with the fluid inlet, and means for sealingly separating the air inlet and the fluid inlet. The module further comprises pilot lighting means for substantially simultaneously igniting an air and fluid mixture discharged from the burner nozzle inserts.

The apparatus may further comprise an air manifold defining an air manifold cavity therein in communication with each of the air inlets. The pilot lighting means preferably is mounted on the air manifold.

In one embodiment, the air port is one of a plurality of air ports, wherein at least some of the air ports have axes which are substantially in a single plane and at least one of the ports has an axis which is angularly disposed with respect to the plane. The plane is substantially perpendicular to a central axis of the nozzle insert.

In an alternate embodiment, the body of each burner nozzle defines a steam inlet in communication with the corresponding body cavity, the nozzle insert further defines a steam port in communication with the steam inlet, and the sealing means is further adapted for sealingly separating the steam inlet from the air and fluid inlets.

The fluid and air inlets of the burner apparatus are coaxial and in a vertical line which allows the apparatus to be easily swiveled as desired. The nozzle inserts are easily removed from and replaced in the apparatus. The apparatus utilizes a pilot and igniter system which is capable of remote ignition and has separate gas tips therein for substantially simultaneously igniting a plurality of burner nozzles. The pilot assembly is easily installed in a tube through the center of the burner module.

A plurality of burner modules may be used to increase the total amount of oil burned by the apparatus. Preferably, but not by way of limitation, each of the bodies of each burner nozzle is positioned approximately equidistant from adjacent bodies.

Operation of the apparatus is quite simple and typically would include the following steps: first, the pilot gas, such as propane, is turned on and the pilot ignited. If separate pilot gas tips are used in the pilot system, these are turned on and ignited by the pilot. Next, the air supply to the burner apparatus is opened, and the operator can quickly determine if the pressure is sufficient. Finally, the oil supply valves are opened, and the system begins to flow oil. The spray is immediately ignited by the pilot gas tips so combustion is essentially instantaneous. The apparatus does not require high oil flow rates, and since atomization is best at low oil flow rates, start-up is quick, efficient and relatively clean.

Numerous objects and advantages of the invention will become apparent as the following detailed description of the preferred embodiment is read in conjunction with the drawings which illustrate such embodiments.

BRIEF DESCRIPTION OF THE DRAWINGS

FIG. 6 illustrates a burner system utilizing a plurality of burner manifolds.

DESCRIPTION OF THE PREFERRED EMBODIMENT

Figure 1:
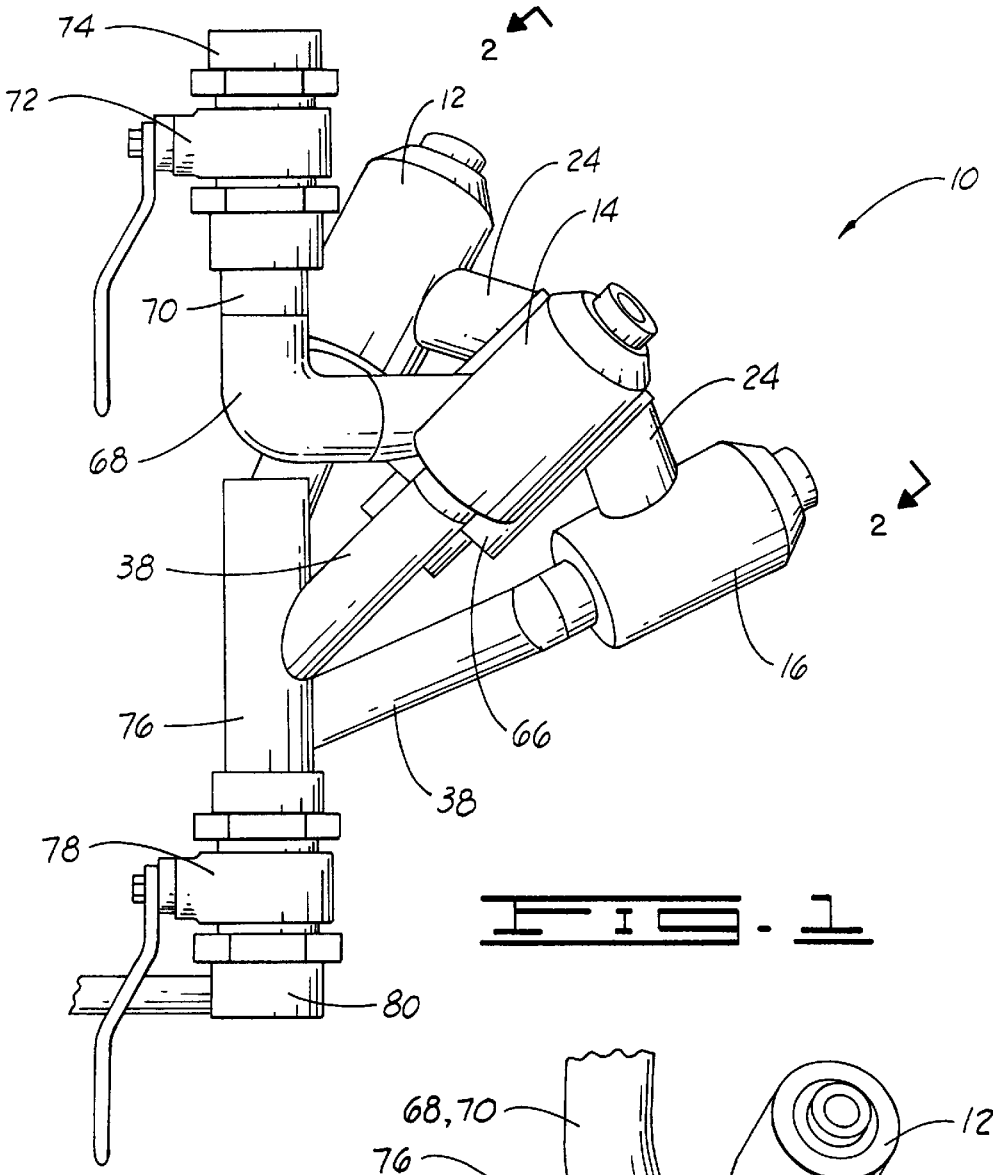
FIG. 1 is a side elevational view of the burner apparatus of the present invention showing a burner module with three nozzle tips.
Figure 2:
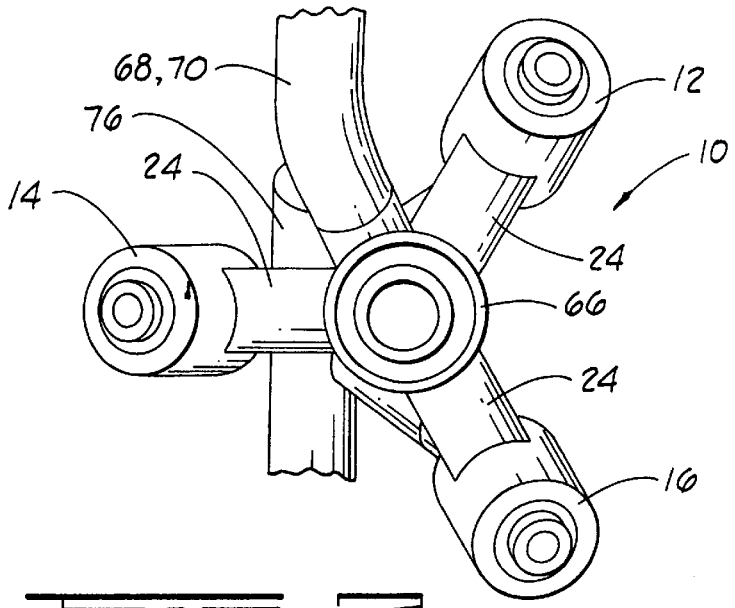
FIG. 2 is an axial view of the burner module as viewed from lines 2—2 in FIG. 1.
Figure 3:
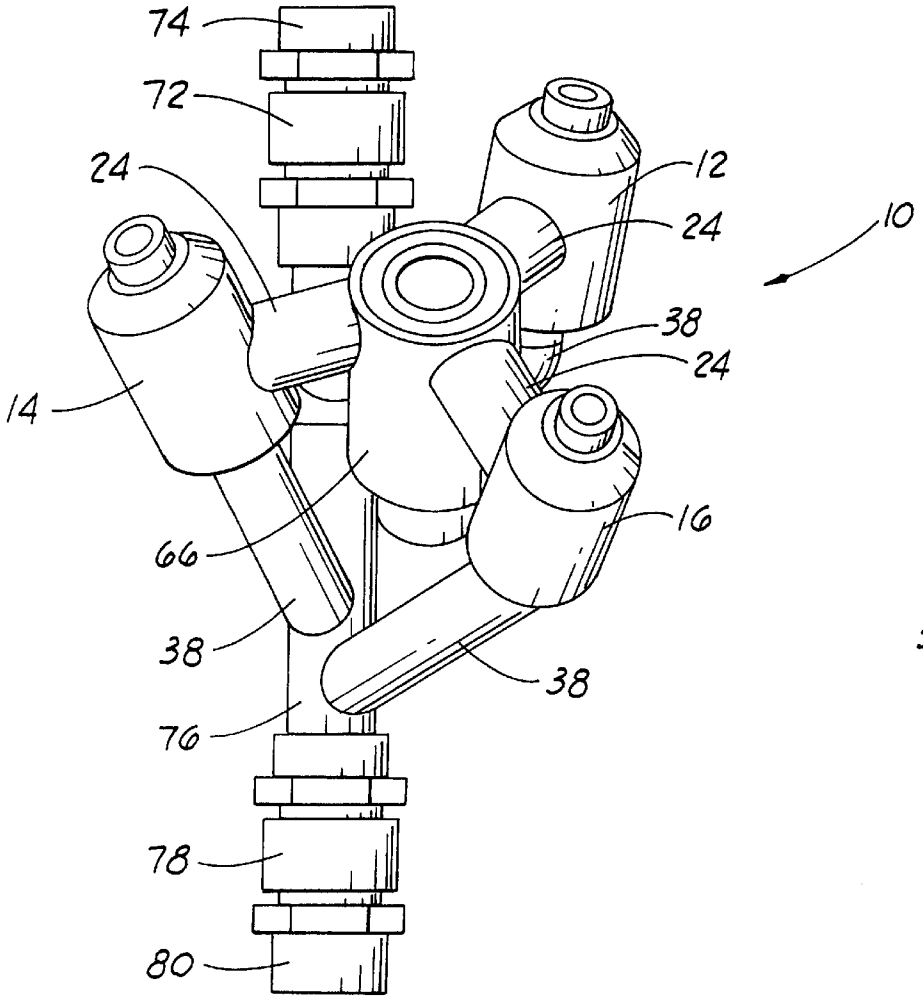
FIG. 3 is another side elevational view of the burner module as seen from the right side of FIG. 1.

Referring now to the drawings, and more particularly to FIGS. 1–3, the burner apparatus of the present invention is shown in the form of a burner module, generally designated by the numeral 10. In the illustrated embodiment, module 10 comprises three burner tips or nozzles 12, 14 and 16. However, the invention is not intended to be limited to a module with three burner tips. Multiple nozzles are usually preferable, but a single nozzle may be used.

Figure 4:
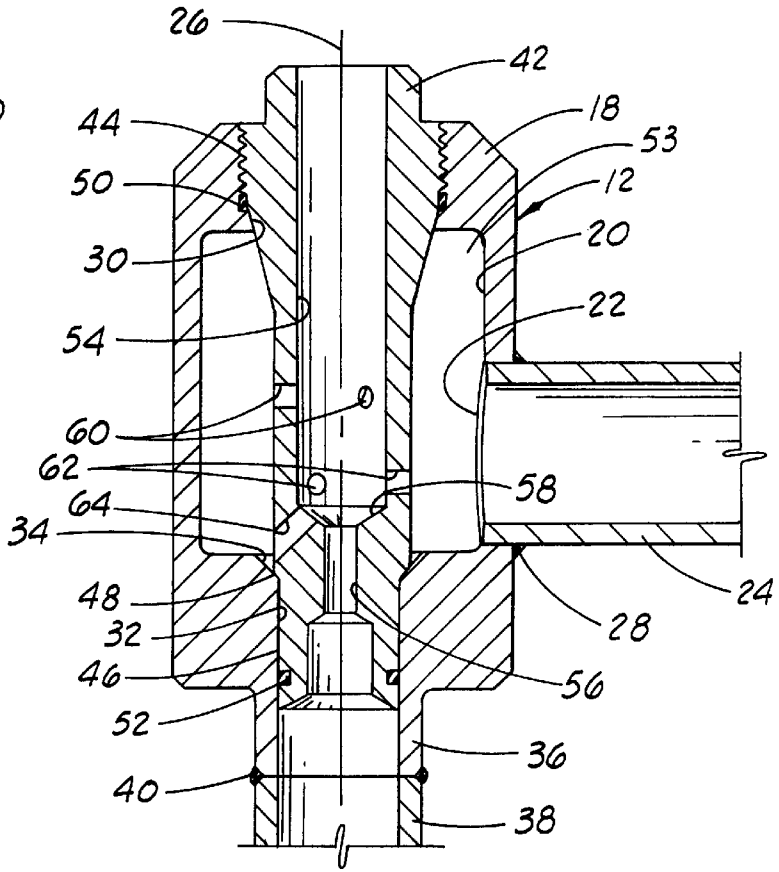
FIG. 4 shows a cross-sectional view of a first embodiment of a burner tip.

Referring to FIG. 4, the details of the burner nozzles are shown. This discussion will refer to burner tip 12, but it should be understood that the construction of burner tips 14 and 16 is substantially identical to that of burner tip 12.

Burner tip 12 comprises a body 18 defining a body cavity 20 therein. An air inlet 22 is in communication with body cavity 20 and is defined by an air inlet line 24. In the preferred embodiment, air inlet line 24 extends substantially perpendicular to a central axis 26 of burner tip 12. Air inlet line 24 may be an integral part of body 18 or may be a separate component attached to body 18 by any means known in the art, such as a weld 28.

Body 18 has a first bore 30 and a smaller second bore 32 therein, each of which defines a portion of body cavity 20. At the upper end of second bore 32 is an upwardly facing chamfer 34. It will be seen that the central axis of first bore 30 and second bore 32 is central axis 26 of body 18.

At the lower end of body 18 is an oil or fluid inlet 36 which is preferably, but not by way of limitation, an integral portion of the body. Second bore 32 extends through oil inlet 36. Oil inlet 36 is adapted for connection to an oil inlet line 38 by any means known in the art, such as a weld 40. While reference is made herein to an oil inlet 36 and an oil inlet line 36, and other components relating to "oil," it should be understood that burner module 10 is also usable on gas or a combination of oil and gas. Thus, the term "oil" as used herein should be interpreted to refer to oil and/or gas or other flammable well fluid.

A nozzle insert 42 is disposed generally within body cavity 20 of body 18 and engaged therewith by a threaded connection 44 at the upper end of the nozzle insert.

The lower end of nozzle insert 42 has an outside diameter 46 adapted for closely fitting within second bore 32 in body 18. Nozzle insert 42 also has a downwardly facing chamfer 48 thereon adapted for engagement with chamfer 34 in body 18.

A sealing means provides sealing engagement between body 18 and nozzle insert 42. In the illustrated embodiment, but not by way of limitation, the sealing means comprises an upper elastomeric seal 50, a lower elastomeric seal 52, and a metal-to-metal seal between chamfers 34 and 48. Thus, air inlet 22 and oil inlet 36 are sealingly separated when nozzle insert 42 is in place. It will be seen that body 18 and nozzle insert 42 define a generally annular volume 53 therebetween which is part of body cavity 20, and the sealing means provides sealing on both sides of this annular volume.

In the illustrated embodiment, nozzle insert 42 has a first bore 54 therein and a second bore 56 with a chamfered shoulder 58 therebetween. It will be seen that second bore 56 is in communication with oil inlet 36 and thus may also be referred to as an oil or fluid orifice or port 56.

A plurality of upper air ports 60 are defined in nozzle insert 52 and provide communication between first bore 54 and body cavity 20, and thus with air inlet 22. Similarly, a plurality of intermediate air ports 62 are also defined in nozzle insert 42. Preferably, but not by way of limitation, upper air ports 60 and intermediate air ports 62 extend radially and substantially perpendicularly with respect to central axis 26. Thus, it will be seen by those skilled in the art that the individual axes of upper air ports 60 are co-planar and perpendicular to central axis 26, as are the individual axes of intermediate air ports 62.

Below intermediate air ports 62 are a plurality of angularly disposed lower air ports 64. Lower air ports 64 preferably have axes which are thus angularly disposed with respect to central axis 26 and open into first bore 54 of nozzle insert 42 at shoulder 58. Thus, lower air ports 64 also provide communication between first bore 54 of nozzle insert 42 and body cavity 20, and also air inlet 22 of body 18.

In the embodiment shown, there are three each of upper air ports 60, intermediate air ports 62 and lower air ports 64, although the invention is not intended to be limited to any particular number of individual ports or rows of ports. Also in the preferred embodiment, upper air ports 60, intermediate air ports 62 and lower air ports 64 are angularly staggered with respect to one another about central axis 26. The stagger of the ports and the different angular relationships between the ports are designed to maximize mixing of air and oil as oil passes upwardly into first bore 54 of nozzle insert 42. This is carried out in an effort to maximize atomization, and thus first bore 54 of nozzle insert 42 may also be referred to as an atomization chamber 54.

Referring again to FIGS. 1–3, burner tips 12, 14 and 16 are substantially evenly spaced about an air manifold 66 and are directed angularly outwardly from a central axis of the air manifold. Air inlet lines 24 provide air communication between each of burner tips 12, 14 and 16 and air manifold 66.

Air manifold 66 is also connected to an air supply line 68 which delivers air from an air supply (not shown), such as an air compressor. Air supply line 68 has a substantially vertical portion 70 with an optional valve 72 therein and means for connecting to the air supply, such as a union 74.

Each of burner tips 12, 14 and 16 are connected to an oil manifold 76 by oil inlet lines 38. Oil manifold 76 is illustrated as a cylindrical tube closed at one end, and thus may also be referred to as an oil inlet line 76. Oil inlet line 76 is vertically oriented and has an optional valve 74 therein and a means, such as a union 80, for connecting to an oil supply (not shown).

Oil supply line 76 and vertical portion 70 of air supply line 68 are preferably coaxial, and it will be seen by those skilled in the art that, prior to tightening of union 74 to the air supply and tightening of union 80 to the oil supply, the entire burner module 10 may be pivoted about a vertical axis to position it as desired.

Figure 5:
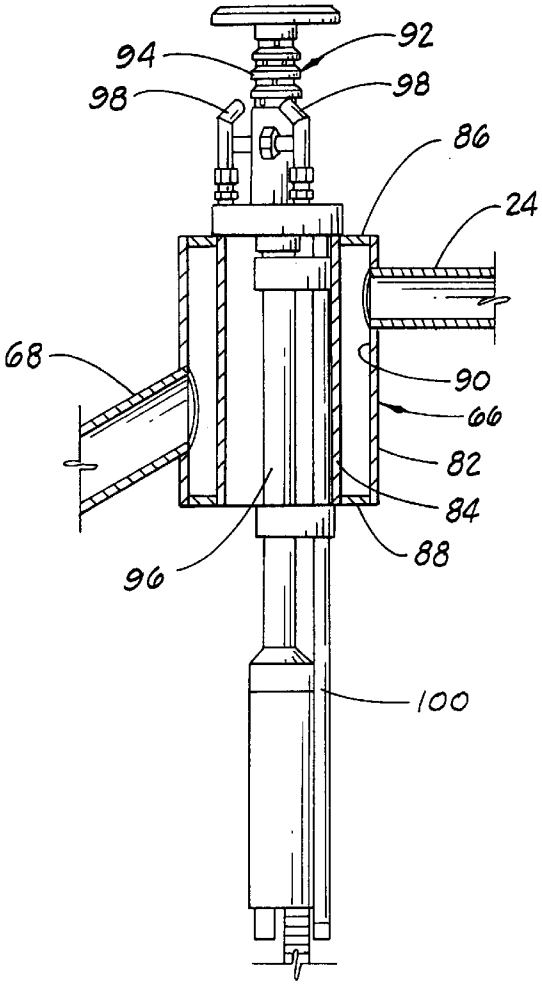
FIG. 5 is a partial cross section and elevational view illustrating a central air manifold with the pilot system installed therein.
Figure 5:
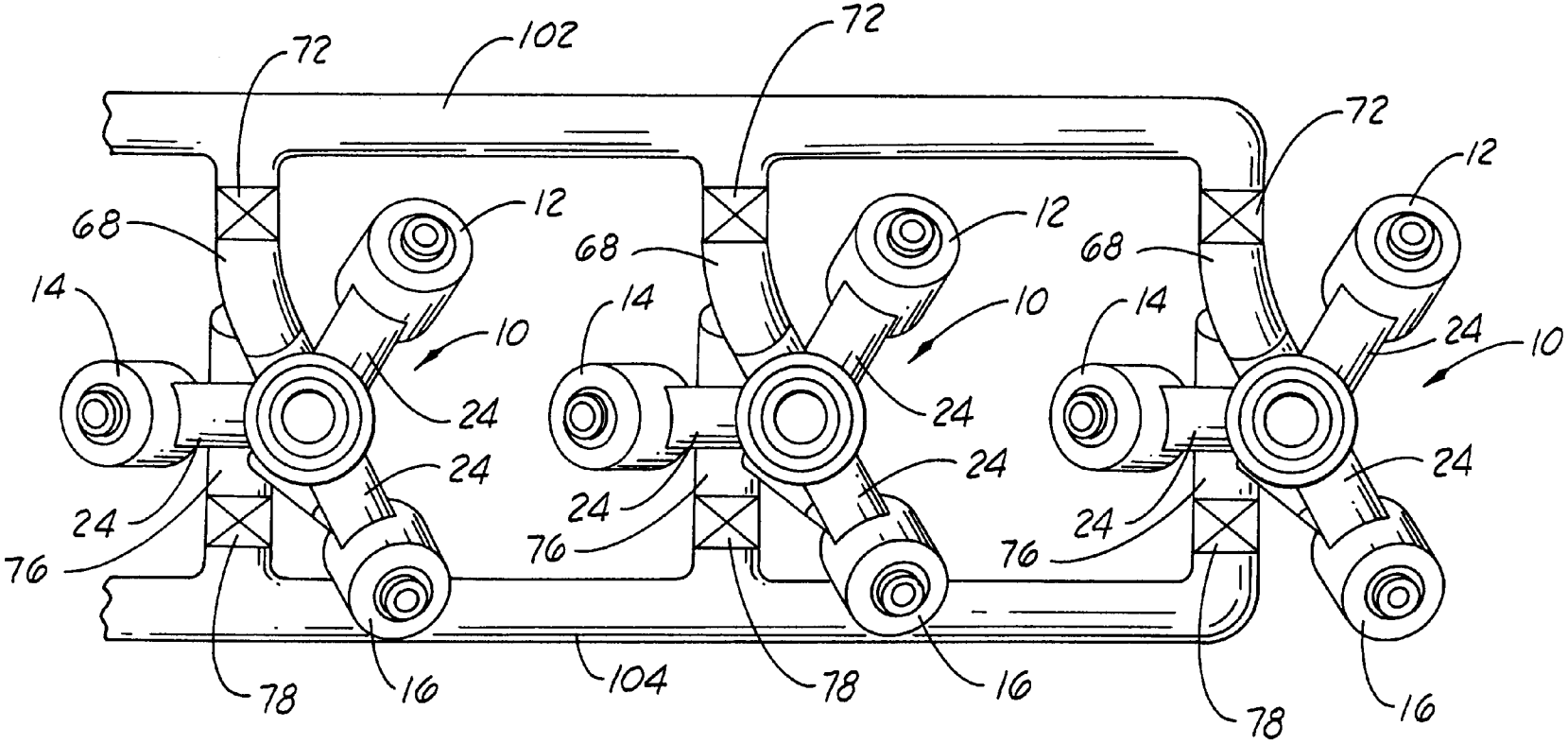

Referring now to FIG. 5, it will be seen that air manifold 66 is formed by an outer cylindrical portion 82 with a smaller, inner cylindrical portion 84 disposed therein. An upper ring 86 interconnects outer cylindrical portion 82 and inner cylindrical portion 84, as does a lower ring 88. Thus, a closed, annular volume or air manifold cavity 90 is defined in air manifold 66 which is in communication with air inlet lines 24 and air supply line 68.

A pilot and igniter system 92 is disposed through inner cylindrical portion 84 of air manifold 66. Pilot and igniter system 92 includes a pilot burner 94 of a kind known in the art connected to a gas supply, such as propane, by a pilot line 96. A plurality of pilot jets 98 are disposed around pilot burner 94, and in the preferred embodiment, pilot jets 98 have angularly disposed tips to direct a pilot flame toward each of burner tips 12, 14 and 16. Each pilot jet is supplied with gas through a jet line 100.

For simplicity, pilot and igniter system 92 is not shown in FIGS. 1–3.

Referring now to FIG. 6, a plurality of burner modules 10 are shown interconnected. Each burner nozzle 10 is substantially identical to the others. Each air supply line 68 is connected to a main air line 102 in a manner such as that previously discussed. Each oil supply line 76 is similarly connected to a main oil line 104.

In the embodiment shown, where there are three burner tips 12, 14 and 16 for each burner module 10, it will be seen that each burner tip is approximately equidistant from adjacent burner tips, regardless of the burner module 10. That is, burner tip 14 of the right-hand burner module 10 is approximately the same distance from burner tips 12 and 16 of the adjacent center burner module 10 as from burner tips 12 and 16 of the right-hand burner module 10. This physical relationship between the burner tips and the angular orientation of burner tips 12, 14 and 16 with respect to the central axis of air manifold 66 results in a mixing of the jetted air streams from adjacent burner modules. This orientation is beneficial because it increases turbulence of the jetted streams and also increases air ingestion, all of which improves the combustion process.

Thus, a three burner tip module 10 is one preferred embodiment. However, depending upon the arrangement of the burner modules, the exact number of burner tips per burner module may be varied, and the total number of burner modules may also be varied and is not intended to be limited to the three burner modules 10 shown in FIG. 6. That is, burner modules with varying numbers of burner tips may be used in a variety of combinations which can also result in good turbulence and air ingestion to facilitate combustion.

Figure 7:
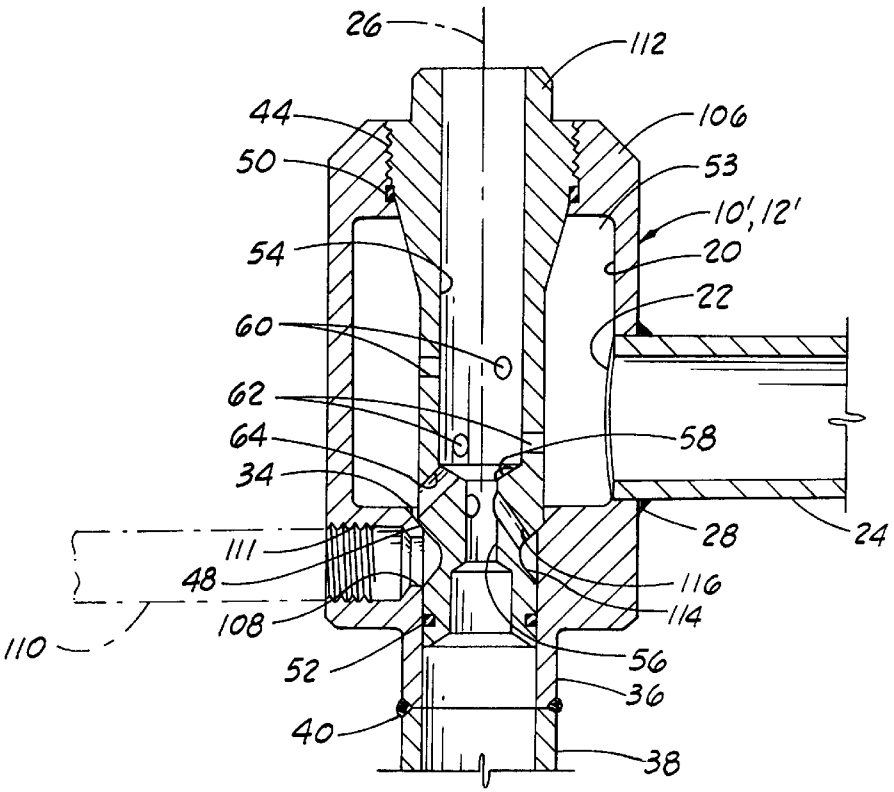
FIG. 7 is a cross-sectional view of an alternate embodiment of the burner tip.

Referring now to FIG. 7, an alternate burner tip 12' is shown as a portion of an alternate burner module 10'. Alternate embodiment burner tip 12' comprises a body 106. The only difference between body 106 and body 18 previously described is that body 106 further includes a steam inlet 108 which is adapted for connection to a steam inlet line 110 by a threaded surface 111. Otherwise, body 106 is identical to body 18, and the same reference numerals will be used herein to identify the various identical features of body 106.

Alternate embodiment burner tip 12' further comprises an alternate nozzle insert 112 which is similar to the previously described nozzle insert 42 for first embodiment burner tip 12. In addition to the features previously described for nozzle insert 42, alternate nozzle insert 112 defines an annular groove 114 which is in communication with steam inlet 108. A plurality of annularly disposed steam ports 116 provide communication between oil port 56 and groove 114, and thus between oil port 56 and steam port 108. Preferably, but not by way of limitation, steam ports 116 angle upwardly with respect to central axis 26. In the illustrated embodiment, three steam ports 116 are contemplated, but the invention is not intended to be limited to this specific number.

Steam enters burner tip 12' and mixes with the oil passing through oil port 56 and is further mixed with the oil as the air enters atomization chamber 54. The steam is easily supplied and adds energy to the mixture to increase atomization. Additionally, the steam aids atomization because it increases the temperature of the oil and air and causes a reduction in oil viscosity. Thus, alternate embodiment burner tip 12' has additional advantages when steam is available.

It will be seen, therefore, that the burner apparatus of the present invention is well adapted to carry out the ends and advantages mentioned, as well as those inherent therein. While preferred embodiments have been described for the purposes of this disclosure, numerous changes in the arrangement and construction of the parts may be made by those skilled in the art. All such changes are encompassed within the scope and spirit of the appended claims.

What is claimed is:

1. A burner apparatus comprising:

a plurality of burner nozzles, each burner nozzle having a central axis and comprising:

a body defining a body cavity therein and an air inlet and a fluid inlet in communication with said body cavity;

a nozzle insert disposed in said body cavity and defining a central opening therethrough and an air port in communication with said air inlet and a fluid port in communication with said fluid inlet; and means for sealingly separating said air inlet and said fluid inlet;

an air manifold having a longitudinal central axis and defining an air manifold cavity therein in communication with each of said air inlets, wherein:

the central axes of a plurality of said burner nozzles are angularly disposed with respect to said central axis of said air manifold; and said burner nozzles are circumferentially spaced from one another about said central axis of said air manifold; and pilot lighting means for substantially simultaneously igniting an air and fluid mixture discharged from said nozzle inserts.

2. The apparatus of claim 1 wherein said pilot lighting means is mounted on said air manifold.

3. The apparatus of claim 2 wherein:

said air manifold defines a central opening therethrough; and said pilot lighting means is at least partially disposed through said central opening.

4. The apparatus of claim 1 wherein the central axis of one of said burner nozzles is angularly disposed with respect to the central axis of another of said burner nozzles.

5. The apparatus of claim 1 wherein said air port is one of a plurality of air ports, at least some of said air ports having axes which are substantially in a single plane and at least one of said ports having an axis which is angularly disposed with respect to said plane.

6. The apparatus of claim 5 wherein said plane is substantially perpendicular to a central axis of said nozzle insert.

7. The apparatus of claim 1 wherein:

said body further defines a steam inlet in communication with said body cavity;

said nozzle insert further defines a steam port in communication with said steam inlet; and said sealing means is further adapted for sealingly separating said steam inlet from said air and fluid inlets.

8. A burner apparatus comprising:

a plurality of burner modules, each burner module comprising:

a plurality of bodies, each body having an air inlet and a fluid inlet;

a nozzle insert disposed in each of said bodies, each nozzle insert having an air port in communication with a corresponding air inlet and a fluid port in communication with a corresponding fluid inlet; and a manifold defining an air chamber therein in communication with the air inlets of each of said bodies;

wherein:

central axes of a plurality of said bodies are angularly disposed with respect to a central axis of said manifold; and said bodies are circumferentially spaced from one another about said central axis of said manifold.

9. The apparatus of claim 8 wherein each of said bodies is positioned approximately equidistant from adjacent bodies.

10. The apparatus of claim 8 wherein:

each of said bodies further defines a steam inlet; and each of said nozzle inserts further defines a steam port in communication with a corresponding steam inlet.

11. The apparatus of claim 10 wherein each of said burner assemblies further comprises sealing means for sealingly separating corresponding sets of said air inlets, said fluid inlets and said steam inlets.

12. The apparatus of claim 11 wherein said sealing means is characterized by:

an elastomeric seal disposed between said air inlet and said fluid inlet and between said steam inlet and said fluid inlet; and a metal-to-metal seal between said air inlet and said fluid inlet and between said steam inlet and said air inlet.

13. The apparatus of claim 8 wherein said nozzle inserts are angled outwardly with respect to a central axis of said manifold.

* * * * *